United States Patent [19]

Hoek et al.

[11] Patent Number: 4,640,031

[45] Date of Patent: Feb. 3, 1987

[54] GAS CYLINDER IDENTIFICATION DEVICE

[75] Inventors: Cornelis Hoek, Oud Beyerland; Jurjen L. van Ditten, Schiedam, both of Netherlands

[73] Assignee: N.V. W.A. Hoek's Machine, Schiedam, Netherlands

[21] Appl. No.: 551,371

[22] Filed: Nov. 10, 1983

[30] Foreign Application Priority Data

Nov. 12, 1982 [NL] Netherlands ..... 8204413

[51] Int. Cl.[4] ..... G09F 3/00

[52] U.S. Cl. ..... 40/306; 40/10 R; 40/310

[58] Field of Search ..... 40/2, 10, 21, 306, 10 R, 40/306

[56] References Cited

U.S. PATENT DOCUMENTS 1,440,109 12/1922 Schenck ..... 220/3
3,052,999 9/1962 Sedgwick et al. ..... 40/625
3,787,993 1/1974 Lyon ..... 40/306
4,155,184 5/1979 Frenette ..... 40/628

*Primary Examiner*—Gene Mancene
*Assistant Examiner*—Wenceslao J. Contreras
*Attorney, Agent, or Firm*—Beehler, Pavitt, Siegemund, Jagger, Martella & Dawes

[57] ABSTRACT

An assembly for recognizing gas cylinders or the like, each provided with a valve and a protection cap for the latter and with a carrier for a code to be read by a reading apparatus provided on the neck of said cylinder. According to the invention on said neck a ring is secured which is adapted for transport of the cylinder in the suspended condition by means of a lifting tool, a removable code carrier being fixed on said ring. In particular said ring is adapted or removably mounting thereon a special protection cap, in particular by means of securing pins, said cap, at the same time, providing a protection of the securing means of the code carrier, and, in particular, comprising a hinged cover for passing connecting means.

15 Claims, 15 Drawing Figures

GAS CYLINDER IDENTIFICATION DEVICE

Figure 1:
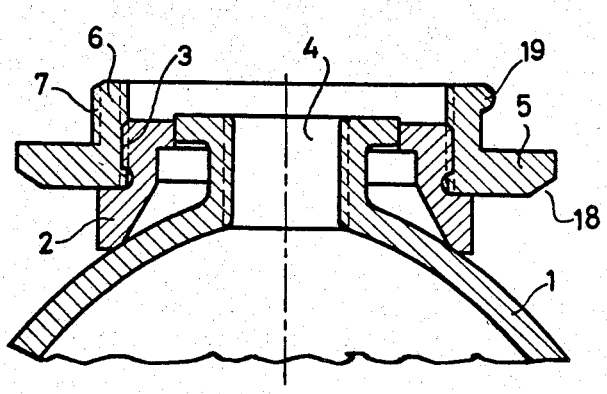

Gas cylinders for storing gases at a high pressure (and, possibly, in liquid or dissolved form) consist of a hollow cylindrical steel body with a narrower neck with a plane terminal surface, in which an opening for connecting a valve is provided, which neck is provided, at its outer side, with screw thread on which a protecting cap for the valve can be screwed.

Such cylinders must comply with severe requirements, as well in respect of their resistance against the occurring high internal pressures as in respect of their resistance against a rough treatment. At regular intervals the cylinders are being subjected to inspection, and then it is checked whether the cylinders still comply with the requirements, and thereafter the approved cylinders will be provided with a punched inspection mark. Moreover such cylinders are provided with punched data relating to the allowable filling pressure, the volume etc., and, sometimes, with a serial number. Furthermore the kind of the gas content is often indicated on the cylinder by means of colours.

The useful life of such cylinders is high so that they can be refilled again a great number of times. On arrival in a filling plant it is, for instance, required to check whether the approval period has not been exceeded, since, otherwise, filling is not allowed and the cylinder is to be inspected first. If said plant is adapted to supply different kinds of gases, the cylinders are to be sorted according to the gas in question, and thereafter the cylinders can be transported to the corresponding filling stations in said plant in order to be filled.

Since, however, empty cylinders often arrive in bundles, and these bundles can comprise cylinders of different kinds and/or for different gases, this will require much manual work, even if the internal transport in the plant can take place by means of transport racks or receptacles and fork lift vehicles or the like. Reading the punched marks is often very difficult, in particular when being soiled and in poor lighting conditions, and the first inspection and sorting is often done in the open air which, in particular in cold or rainy weather, can be very onerous. A simplification of these operations is, therefore, desirable. Also a simplification of the further handling of the gas cylinders, such as the distribution thereof over the filling stations for different gases, adjusting the filling degree, and introducing the various fillings into a book-keeping system, can be desired, if such operations will, in the current mode of working, restrict the obtainable output of a filling plant, and also promoting safety can be important.

In the past several coding systems have been proposed for this purpose. CH Pat. No. 418 373, for instance, discloses an annular code carrier to be fixed on the collar of a gas cylinder, and provided with a plurality of magnetic elements distributed over the circumference of said carrier, in particular pins inserted into holes provided in said carrier, and the code can be read by means of a, at least partially, circular reading apparatus adapted to grip around at least a part of said annular code carrier. Apart from the fact that using such a reading apparatus is rather time consuming, an important draw-back is that the code cannot easily be changed, which is necessary when the cylinder is re-inspected and, moreover, the annular carrier can be easily removed from the neck of the cylinder. Furthermore there are no means for facilitating transport through the filling plant. Moreover the coding system has a relatively low capacity, so that only a restricted amount of information can be coded in this manner.

In FR Pat. No. 1 534 788 a coding system is described having a sufficiently large capacity for encoding all the important information, wherein holes or grooves are provided in a wall part surrounding the valve, and this code can be read by placing a special reading head over said wall part which is adapted to direct air flows through said holes or grooves in order to detect the presence or absence of such a hole or groove. Such a reading head cannot be used in the case of cylinders provided with a protecting cap, and, moreover, as in the case of the first-mentioned reference, such a reading head does not allow a quick reading of the code, and the latter cannot be easily changed or replaced. Also in this case means for easily transporting such cylinders are not disclosed.

It is an object of the invention to provide an assembly for recognising gas cylinders, which can be mounted on the current gas cylinders without changes, and is provided with a code carrier with an easily readable code, which carrier can be protected against unauthorised removal thereof, but can be easily replaced by a new code when the cylinder is being inspected, which assembly is, furthermore, adapted for easily transporting the cylinder in question.

To that end the assembly of the invention is characterised by a ring which can be screwed and secured on external screw thread of the neck, and is adapted to be engaged by a lifting tool for transport in the suspended condition, said ring being provided with a code carrier which can be locked thereon and is removable therefrom, and, in particular, the fixing means for the code carrier are covered by the protecting cap.

In order to avoid that cylinders which have been exposed to high temperatures will be used again without inspection, the code carrier can be constructed so that when exposing the cylinder to exceptionally high temperatures the code bearing part is detached from the cylinder or becomes unusable.

In order to allow a quick reading of the code, preferably from a distance and without using reading means which must be contacted with the carrier, the code used according to the invention is the well-known bar code, and currently available laser-beam reading means can be used for reading such a code.

In order to facilitate the handling of a cylinder provided with an assembly of the invention, the ring is provided with two diametrically opposed ears adapted to be engaged by fork arms of the lifting tool.

In particular said ring is provided with recesses in which the code carrier fits, which carrier is provided with claws fitting in holes in the ring, opening into apertures through which the claws are accessible after removing the protecting cap, and, in particular, the ring is provided with an aperture in which the lower rim of the cap fits and in which the cap can be fixed by means of securing pins, said pins, preferably, being fixed in the ring by means of a snap locking means, which locking means can be released by turning the pins.

The opening in the ring and the lower rim of the cap have, in particular, the same polygonal shape, allowing to position the cap in different orientations in respect of the ring.

In such an assembly, in which the cap is provided with two diametrically opposed apertures through which the valve is accessible, the cap can be provided with an upper part which is hingedly connected with one of the wall parts not provided with an aperture, and can be fixed by means of a latch on the other wall part.

The chosen location of the code carrier has several advantages. When bundling or stacking as well as rolling gas cylinders, the neck part remains, generally, outside the impact region so that directly damaging as a consequence of the rough handling can be avoided in most cases. Moreover this location has the advantage that it can be unambiguously recognised, and is situated at a given distance from the connecting opening of the valve. Since cylinders of different lengths exist, it will be favourable, when automatising the transport, to transport the cylinders so that the valve openings are being supported at a fixed height, so that transport means are to be used by means of which the cylinders can be supported in a suspended manner with a substantially vertical axis, and the code carriers of the invention which are arranged at a fixed distance of the suspension points can co-operate, then, with reading apparatuses mounted in fixed points along the transport paths.

Figure 2:
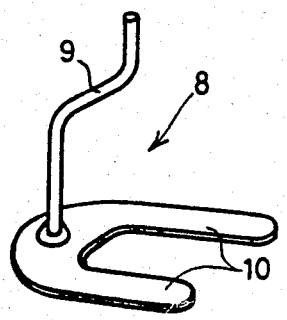
Figure 4A:
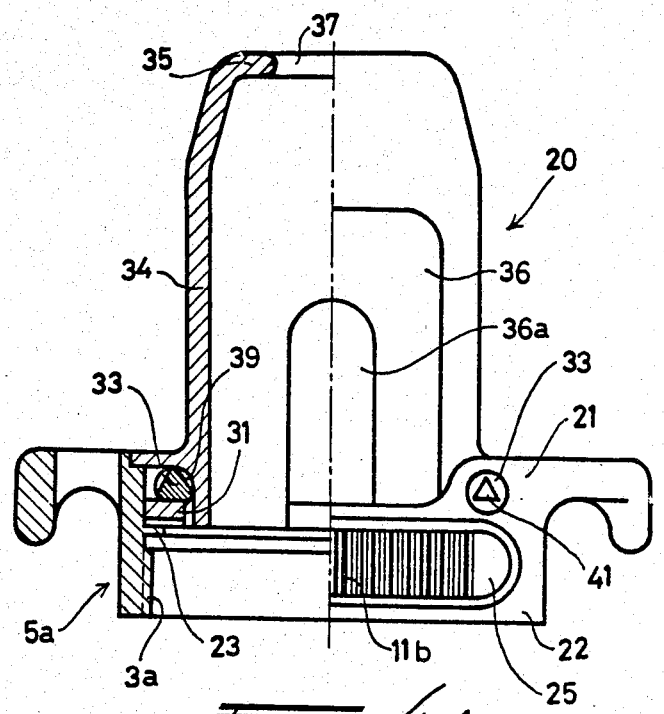
Figure 4B:
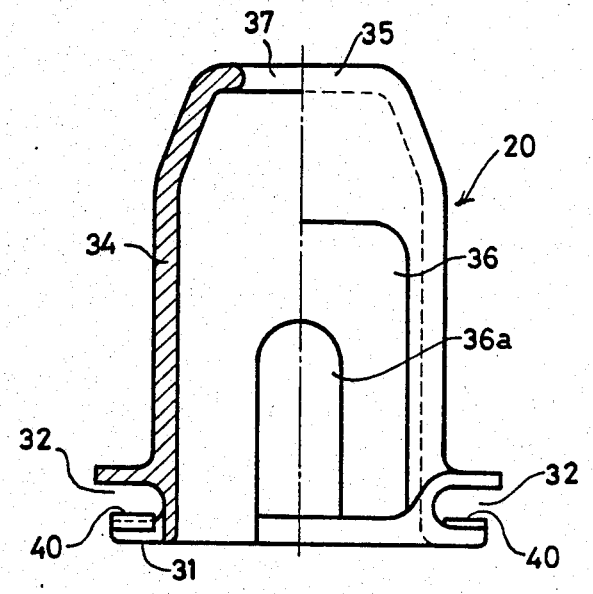
Figure 5B:
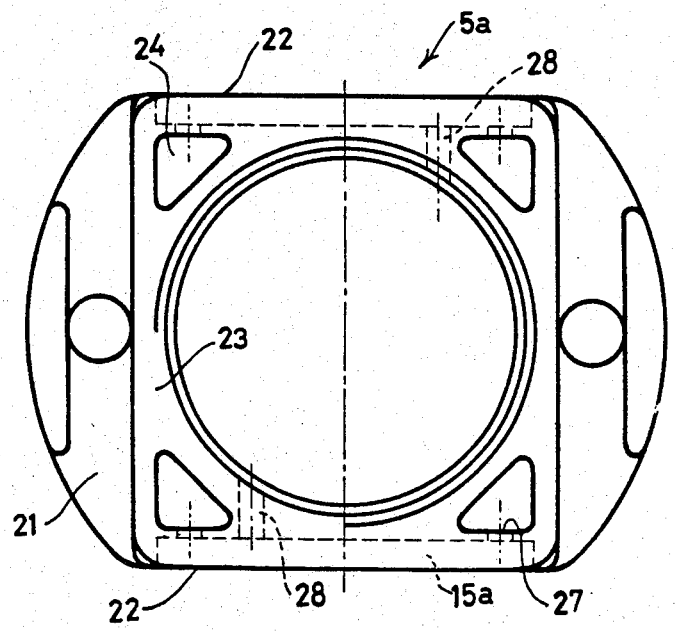
Figure 5A:
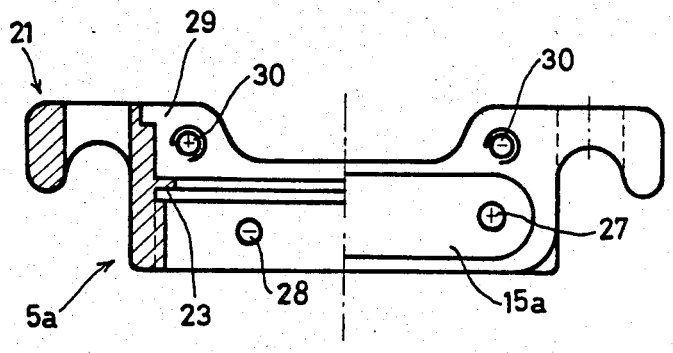
Figure 6:
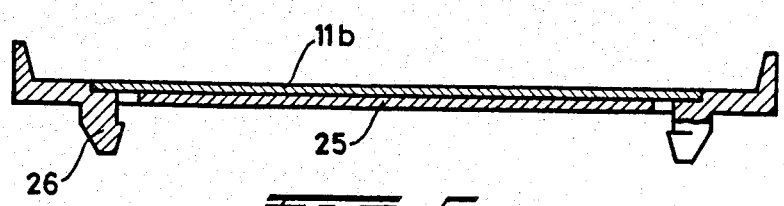
Figure 8:
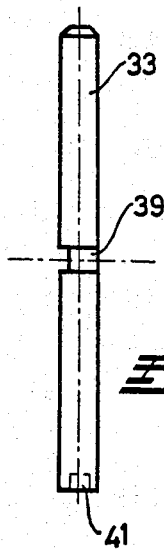
Figure 7:
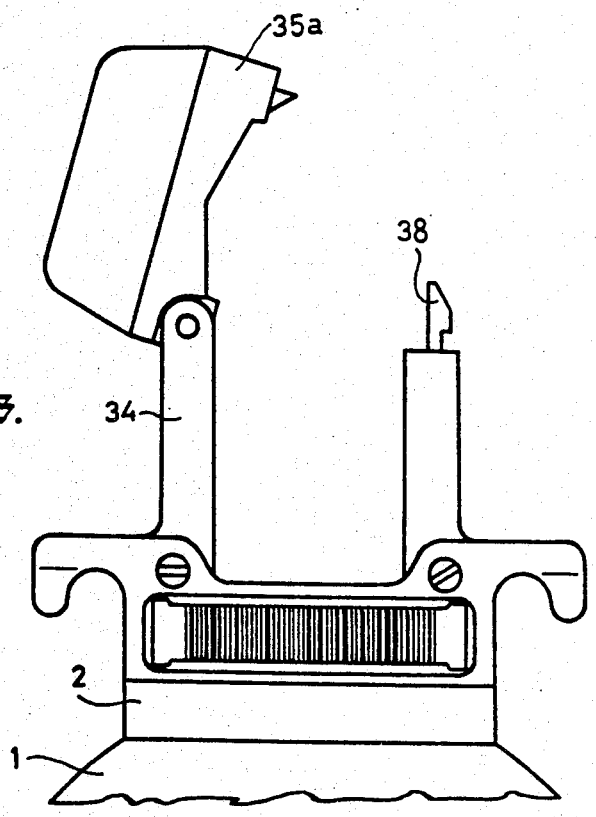

The invention will be elucidated below by reference to a drawing, showing in:

FIG. 1 a highly simplified cross-section of the upper part of a gas cylinder with a code carrier disc of the invention mounted thereon;

FIG. 2 a simplified representation in perspective of a supporting hook for transporting gas cylinders of FIG. 1 in the suspended condition;

FIGS. 3A–F diagrammatical partial representations of the disc of FIG. 1, showing various possibilities for fixing a code carrier;

FIGS. 4A and B side views, partly in section, of a preferred embodiment of the assembly of the invention with a special protecting cap and, respectively, of such a cap;

FIGS. 5A and B a side and plan view respectively, partly 35 in section, of the elements of FIG. 4A;

FIG. 6 a section, at a larger scale, of a code carrier element of the assembly of FIG. 4A;

FIG. 7 a view corresponding to FIG. 4B of a slightly modified embodiment of said cap; and FIG. 8 a view of a securing pin for releasably fixing the caps of FIG. 4A and 7.

In FIG. 1 the upper part of a gas cylinder 1 is shown, having a neck portion 2 which is provided with outer screw thread 3, which, in the current gas cylinders, serves for screwing thereon a protecting cap for a valve provided in a central opening 4 of the cylinder.

In the embodiment of the invention shown, a ring or disc 5 is screwed on the neck screw thread 3, the outer diameter thereof being not larger than the larger diameter of the cylinder, so that, when rolling the cylinder, the rim of said disc remains free from the rolling surface. Also when stacking or juxtaposing cylinders in a rack, the various discs will not touch each other. After being screwed on the thread 3, this ring or disc 5 will be secured in a suitable manner, e.g. by means of a securing screw or pin, one or more tack welds, a glue layer provided in the screw thread or the like. The screw connection and the disc are strong enough to allow the cylinder to be suspended on the disc. This means that substantially the whole screw thread 3 of the cylinder is to be used so that insufficient screw turns will remain for screwing a protecting cap thereon.

In order to allow a protecting cap to be screwed on the screw thread 3, the disc 5 is provided with a collar 6 with external screw thread 7, on which the protecting cap can be screwed. If required the screw thread 7 can have the same diameter as the screw thread 3 in order to allow the use of the current protecting caps. As a consequence of providing the disc 5, however, the cap will be positioned higher than when screwing it on the screw thread 3, and then also the apertures in the cap through which the connecting opening of the valve is accessible will become situated higher, so that, then, a spacer is to be used. Generally it is advisable, however, to introduce new protecting caps when introducing the discs 5, so that, then, it is not necessary to change the manner of fixing the valves.

The disc 5 can be used for transporting the associated cylinder 1 in the suspended condition. This disc can, for example, be gripped by means of a suitable gripper with three claws. FIG. 2 shows a particularly suitable tool 8 consisting of a bent suspension rod 9 adapted to be suspended on a conveyor, and connected, at its lower end, to a fork 10 which can grip below a disc 5, the bends of the rod 9 being such that the upper end thereof will be aligned with the axis of a suspended cylinder when the disc 5 is bearing on the fork 10. This fork is, preferably, rotatable around the suspension point and said axis. Such a tool is very simple and allows an easy engagement and disengagement of the cylinders. The fork legs can be provided with stops or can have such a rearward inclination that a disc 5 is retained against falling out, and is unambiguously kept in the axis of the suspension rod 9.

The disc 5 is located in a fixed location in respect of the upper end of the cylinder and of the valve screwed into the opening 4, and, moreover, will be maintained at a fixed height in respect of the conveyor track when transported in the suspended condition. This disc is, therefore, extremely suitable for providing thereon a recognition code adapted to be read by means of a reading apparatus mounted in a fixed relationship to the conveyor track. Also when using portable reading apparatuses, this disc is favourable since the latter provides a code area which can be quickly and unambiguously found. Still another advantage of this disc is that it allows to protect the code carrier against damage without impairing its accessability for a reading apparatus.

As such any coding mode which is resistant against the rough handling to which gas cylinders are subjected is suitable for encoding gas cylinders. Preferably use is made of a code provided on a separate band or strip which is, at least partially, modifiable, in order to allow to adapt the inspection date of a cylinder at each inspection. This code should, then, remain readable under any circumstances, specifically also when soiled. However a code which can be read from a distance is preferred, in particular a bar code which can be read from a distance by means of a laser apparatus. Such a bar code can comprise, within a restricted area, a large amount of information which is favourable in the present case, since data such as the net weight of the cylinder, the weight of its contents, the kind of gas, the inspection date, the owner, the serial number of the cylinder etc., can be recorded on a carrier of relatively small dimensions, and such a code can be easily provided on a plate or the like which is resistant against corrosion, which is particularly important at a re-inspection when the plate is to be replaced by an other one.

Figure 3A:
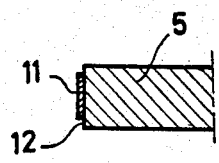
Figure 3B:
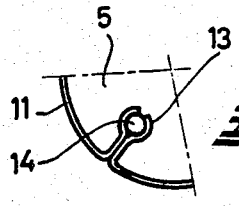

FIG. 3 shows a number of ways for applying such an encoded band or strip 11 on a disc 5. At A the band is fixed directly on the outer surface 12 of the disc 5, e.g.

by means of screws or rivets not shown, or by means of a glue connection disengaging on being heated. FIG. 3B shows a special manner of fixing, in which the extremities of a band 11 are inserted into a keyholeshaped recess 13 of the disc 5, and are fixed therein by means of a plug 14. This plug can consist, for instance, of a material melting or softening on being heated (e.g. a metal alloy or plastic) which, when the code band is to be disengaged, can be removed by local heating, which, also on overheating the gas cylinder which might cause damage to the cylinder or the valve, will get loose, thus forming an indication of the risk of damage. This security is also obtained when glueing the band, but then the band, and therefore the code of the cylinder, may get lost.

Figure 3C:
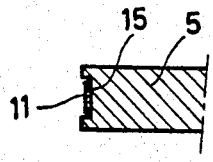
Figure 3D:
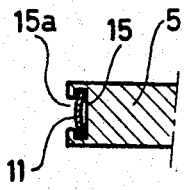

A draw-back of tensioning the band 11 around the edge of the disc 5 is that it can be damaged by impact effects. FIG. 3C shows an embodiment in which the band 11 is received in a groove 15 of the disc 5. FIG. 3D shows such a groove with a slightly narrowed opening 15*a* in which a band 11 with a curved cross-section is elastically fixed. Inserting the band can take place in a widened part of the opening 15*a*, and insertion can be facilitated by manufacturing the band from a material which, on being heated, obtains a different curvature (e.g. a bi-metallic strip) or becomes more flexible.

Figure 3F:
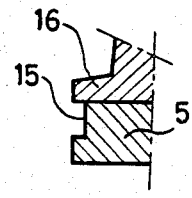
Figure 3E:
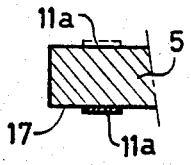

It is also possible to provide the protecting cap in the manner of FIG. 3E with a flange 16 covering the groove 15 of the disc 5. Also in the case of the fixation according to FIG. 3B the flange 16 can cover only the recess 13 for retaining the plug 14. Such a flange 16 can also be used for binding or securing the code carrier 11 on the disc 5 in another manner.

FIG. 3F shows a band 11*a* in the form of a ring or ring segment fixed on the lower surface 17 of the disc 5, but can, of course, also be fixed on the upper surface. In this manner too an effective protection of the code carrier against damaging can be obtained. This manner of fixing can be favourable if the fork legs 10 of the suspension element 8 of FIG. 2 are provided with suitable sensors.

The code band should, at least partly, be replaceable or re-encodable, since, at each re-inspection, the inspection date is to be changed or the extension of the approval is to be indicated in another manner. In the case of a magnetic code, re-encoding can take place without removing the band from the disc, but in the case of a punch or bar code at least the part to be re-encoded should be removed. If, on re-inspection, a new code band is made, the old one can, for instance, be introduced into the encoder which introduces the date set therein in the new band and copies the fixed code parts from the old one which, if required, can be invalidated automatically thereafter.

If the code band (or a number of code bands) is placed in a definite orientation in respect of the connecting opening of the valve (which is simple, in particular in the embodiments of FIGS. 3D and E), this band can, at the same time, be used for positioning the cylinder in a filling station in the correct orientation in respect of the filling connections of the filling device. Driving rollers engaging the outer rim 12 of the disc can be used then.

It is, of course, also possible to apply the code band on a flange rim of the protecting cap, but the draw-back thereof is that, when removing the cap, the connection with the cylinder is lost. If necessary the band 11 can be used as a warrant strip which is only applied after placing the cap, and is to be removed before the cap can be screwed off.

Besides by means of a band 11 or the like, the king of filling gas for which the cylinder is intended, which seldom or never is to be changed, and the number of which is small, can be encoded in another manner, for instance by means of a bevel or an other edge code as shown in FIG. 1 at 18, and it is also possible to use the dimensions of the disc or disc parts for this purpose. Suspension means in the case of suspended transport can be provided with suitable sensors which are sensitive for such differences in shape or dimensions. If the cylinder is to be used for a different gas, the disc 5 is to be removed then and is to be replaced by another one.

When the cylinders to be filled enter a filling plant, they are to be sorted first as to the filling gas, and are to be inspected as to the validity of the approval. If the code is used for controlling an automatic transport system, it is sufficient to hook the cylinders in the suspension means of the system, and thereafter reading apparatuses placed in suitable points can actuate switching means by means of which the cylinders are directed towards the intended points of destination. One of the points of destination is, then, a collecting station for cylinders with an expired approval period. When introducing the cylinders in the transport system, the cylinders can be inspected for coarse damages, loose code carriers and the like.

In the filling station the connection with the filling duct can be brought about by hand or automatically, and when weighing is to be performed, the code can indicate the empty weight and the filling weight, and when filling to a given pressure the code indicates the admissible pressure, and either the filling device is controlled accordingly, or the cylinder is guided towards an adapted filling station.

Finally the various data can be transmitted towards a book-keeping system, and, moreover, if the code comprises the recognition number of the cylinder, this number can be introduced into a processing system for statistical purposes.

It is, of course, also possible to use the recognition code of the cylinder only, and then all the constant and variable data thereof are stored in a memory which can be interrogated in the various points of interest. Such a code is only feasible in the case that the plant uses mainly its own cylinders, and if, in the case of subsidiary plants, a connection with a central memory is practicable. Including all the data of interest in the code, on the other hand, allows to handle the cylinders also in other plants, if a standardised code is used. The latter mode of operation is, therefore, preferred.

It will be clear that such a code is also feasible in the case of not automatised transport, and, in particular, can be used initially, during switching over to coding, for sorting the cylinders only, and then portable reading apparatuses can be used. Also in smaller filling plants in which automatic transport is less feasible, and particularly in plants in which only one kind of gas is being used, less data have, then, to be read accordingly.

In order to ensure that the apertures of the protecting cap will be directed in the correct orientation in respect of the connecting opening of the valve, this cap can be provided with securing means, e.g. a tensioning bolt by means of which a split collar of the cap can be tensioned in order to clamp the cap on the screw thread. Since, now, the screw thread 3 is no longer to be used, it is no longer required to provide the cap with screw thread, and securing by means of a clamp is sufficient, so that, then, the collar 6 can be made smooth. As shown in FIG. 1, the collar 6 can be provided with a thicker rim 19 behind which the cap can be fixed.

In FIGS. 4–8 a preferred embodiment of an assembly to be arranged on a gas cylinder neck 2 is shown, comprising a ring 5*a* provided with a code carrier, and a protecting cap 20 to be described below for protecting the valve to be placed in the opening 4 of a gas cylinder 1.

The ring 5*a* is, as appears from FIG. 5, about square in plan view, and is provided, at opposite sides, with ears 21 in which fits a lifting tool 8 according to FIG. 2, which ears are preferably, as shown, rounded so that they can be used as handles when lifting a cylinder by hand. Between these ears 21 parallel walls 22 are situated. The screw thread 3*a* of the ring 5*a*, fitting on the screw thread 3, extends only through the lower part of the ring 5*a*, and terminates in a transverse wall 23 which is provided with substantially triangular apertures 24.

In the walls 22 shallow recesses 15*a* are formed in which a carrier 25 (FIG. 6) for a code strip 11*b* fits. This carrier 25 consists, for instance, of plastic, and the code strip 11*b* which is, preferably, provided with a bar code, consists, for instance, of a suitable metal, e.g. anodised aluminium, into which the code can be branded. The carrier 25 is provided with claws 26 fitting in holes 27 in the ring 5*a*, which holes open into the triangular apertures 24. When the cap 20 has been removed from the ring 5*a*, the claws 26 can be bent away or severed by means of a suitable tool, after which the carrier 25 can be taken away for being replaced by another one, in particular with a new inspection date.

In each wall 22 a recess 15*a* is present, so that a code carrier 24 can be provided at two sides which enhances the readability, since, then, a cylinder is to be rotated less for allowing to perform a reading.

After removing one of the code carriers 25, a hole 28 is uncovered, in which a securing screw can be screwed for securing the ring 5*a* on the neck 2.

The parts of the ears 21 situated above the transverse wall 23 and the lateral walls 22 define a square opening 29, the transverse wall 23 forming the bottom thereof. In the walls 22 pairs of aligned holes 30 are present, the purpose of which will be explained below.

The ring 5*a* is made of a strong material, in particular a cast metal. It is intended that this ring 5*a*, after having been secured on a cylinder, will not be removed therefrom anymore. The ring should not only be able to carry the weight of the cylinder when lifted at the ears 21, but should also withstand heavy impact loads.

In the square opening 29 of this ring 5*a* fits the square lower rim 31 of the special cap 20 which can be made of a strong impact-resistant plastics. This rim 31 protrudes outwards from the cap proper. In two parallel sides of this rim 31 slots 32 are formed, having a centre-line distance which is substantially equal to that of the hole pairs 30 in the walls 22 of the ring 5*a*. When the cap 20 is placed with its lower rim 31 in the opening 29 of the ring 5*a*, two securing pins 33 can be inserted through the holes 30 and the slots 32, and can be fixed therein in a suitable manner. The cap 20 is, then, strongly connected with the ring 5*a*. The rim 31 of the cap 20 then covers the triangular apertures 24, so that the claws 26 of the code carriers 25 are no longer accessible then.

The cap 20 comprises four lateral walls 34 and a rounded upper wall 35, and the latter can be gripped with a hand when rolling a cylinder, as is usual also in the case of the current round steel protecting caps. In two opposite walls 34 apertures 36 and 36*a* resp. are formed, the larger one 36 thereof being intended for making accessible the connecting opening of the valve secured in the cylinder, and the smaller one 36*a* serving for allowing to fix a security strap on the rear side of this valve, as required in the case of several gases. Since the cap 20 can be placed on the ring 5*a* in two orientations, it is always possible to place the larger aperture 36 in front of the connecting opening of the valve, since the sealing means of the valve always allow to rotate this valve over at least 90°. In the upper wall 35 an axially directed hole 37 is provided, allowing to insert a handle or key for actuating the valve. The cap is, therefore, not to be removed when using the cylinder.

In the case of so-called medical gases special fixation straps are used which are provided with code pins cooperating with corresponding code elements of the valve connection, in order to prevent that a connection is made with a cylinder with a gas other than the gas for which the connection is intended. These straps are narrower and do not fit around the cap 20. In that case a special embodiment of the cap will be used as shown in FIG. 7, and the upper part 35*a* thereof is hingedly connected with one lateral wall 34, and can be swung upwards for passing the strap, which upper part 35*a* can be fixed by means of an elastic latch hook 38.

For latching the cap 20 on the ring 5*a*, pins 33 provided, for instance with a threaded end can be used, and always one of the holes 30 of a pair is, then, to be provided with screw thread. Another solution is shown in FIG. 8, in which the pins 33 comprise a middle portion 39 having plane surfaces lying within the cylinder wall of the pin in question. In a wall of the slots 32 in the lower part 31 of the cap 20, resilient lips 40 are formed which, when inserting a pin 33 and rotating it, will engage one of these surfaces so that the pin is secured against being shifted. When rotating a pin 33, the spring is pressed away, and then the pin can be pushed out of the hole 30. The pins 33 can be provided with a specially shaped opening 41 which can be engaged by an adapted key. An advantage of this manner of latching is that the securing springs are normally released, so that the elasticity thereof will not deteriorate.

Within the scope of the invention many modifications are possible. In particular the code bands 11 or strips 11*b* can be coloured, the colour indicating, for instance, the filling gas or the year of inspection, which simplifies the primary sorting of gas cylinders to be filled.

We claim:

1. A combination lifting aid/code carrier device for use with cylindrical gas containers of the type having a valve neck of reduced diameter relative to the container diameter, the valve neck including an upper end, said device comprising:

a ring body;

mounting means for securing said ring body on to the cylinder neck;

said ring body having portions extending radially to the neck and engageable by a lifting tool for lifting a gas container secured to the ring body for transport in a suspended condition;

said ring body being of reduced dimension relative to the cylinder diameter so as to be protected from lateral impact on the container; and code carrier means disposed within a recess in said ring body, a protective cap removably affixed to said ring body, said code carrier having claw elements removably securing said code carrier to said ring body, said claw elements being accessible for disengagement from said ring body only upon removal of said protective cap;

said mounting means being configured and constructed for positioning said code carrier means at a predetermined distance from said upper end when said ring body is seated on the cylinder neck.

2. The device of claim 1, wherein said ring body is provided with thread means engageable with threading provided on the cylinder neck.

3. The device of claim 1, further comprising protecting means attachable to said ring body, said code carrier means being detachable from said ring body, said code carrier means including fastener means releasably engageable with said ring body, said fastener means being accessible for release only upon removal of said protecting means.

4. The device of claim 1, wherein said ring body includes two diametrically opposed ears adapted to be engaged by a forked lifting tool.

5. The device of claim 1, further comprising valve protecting means removably attachable to said ring body for covering a valve mounted to the cylinder neck, said valve protecting means also covering said code carrier means against damage or soiling.

6. The device of claim 1, wherein said code carrier means includes temperature sensitive means for visually indicating past exposure of the gas container to high temperature such as would make reuse of the container unsafe.

7. The device of claim 1, wherein said code carrier means is recessed within said the ring body for protection against damage.

8. The device of claim 1, further comprising a valve protecting cap provided with two diametrically opposed apertures through which the container valve is accessible, said cap being hingely connected to said ring body for movement between an open and a closed position, and including latch means for fixing the cap to said ring body in said closed position.

9. The device of claim 1, wherein the code on said code carrier is a bar code.

10. A combination lifting aid/code carrier device for use with conventional cylindrical gas containers of the type having a valve neck of reduced diameter relative to the container diameter, the valve neck including an upper end, said device comprising:

a ring body;

mounting means adapted for securing said ring body onto the neck of a conventional unmodified gas cylinder container;

said ring body having laterally extending portions engageable by a forked lifting tool for transport of the gas cylinder in a suspended condition;

said ring body being of reduced dimension relative to the cylinder diameter so as to be protected from impact on the container; and valve protecting means attacheable to said ring body;

code carrier means attached to said ring body, said code carrier means including fastener means releasably engageable with said ring body, said fastener means being accessible for release only upon removal of said valve protecting means;

said mounting means being configured and constructed for positioning said code carrier means at a predetermined distance from said upper end when said ring body is secured on to the neck of the unmodified gas container.

11. The device of claim 10 wherein said valve protecting means also covers said code carrier for protection against damage or soiling.

12. The device of claim 10 further comprising temperature sensitive means for visually indicating past exposure of the gas cylinder to high temperature such as would make reuse of the container unsafe.

13. The device of claim 1 wherein said ring body defines a seat aperture in which fits the lower rim of said protective cap, and further comprising securing pins for fixing said cap to said ring body.

14. The device of claim 13 wherein said securing pins are flexible to the said ring body by means of snap locking means, said snap locking means being releasable by rotation of said securing pins.

15. The device of claim 14 wherein said seat opening in said ring body and the lower rim of said cap both have the same polygonal shape so as to allow positioning of the cap in different orientations relative to said ring body.

* * * * *